166-308

9/1/87 XR 4,690,214

United States Patent [19]

Wittrisch

[11] Patent Number: 4,690,214

[45] Date of Patent: Sep. 1, 1987

[54] METHOD AND A DEVICE FOR CARRYING OUT MEASUREMENTS AND/OR OPERATIONS IN A WELL

[75] Inventor: Christian Wittrisch, Rueil Malmaison, France

[73] Assignee: Institut Francais du Petrole, Rueil-Malmaison, France

[21] Appl. No.: 596,604

[22] Filed: Apr. 4, 1984

[30] Foreign Application Priority Data

Apr. 7, 1983 [FR] France ..... 83 05823

[51] Int. Cl.[4] ..... E21B 23/00; E21B 47/00; E21B 49/00

[52] U.S. Cl. ..... 166/250; 166/65.1; 166/308; 166/382; 166/385

[58] Field of Search ..... 166/250, 254, 255, 381, 166/308, 382, 385, 387, 64, 65 R, 69, 72

[56] References Cited

U.S. PATENT DOCUMENTS

| | | | |
|---|---|---|---|
| 2,844,205 | 7/1958 | Carothers | 166/250 |
| 3,208,521 | 9/1965 | Holland et al. | 166/65.1 X |
| 4,109,717 | 8/1978 | Cooke, Jr. | 166/250 |
| 4,349,072 | 9/1982 | Escaron et al. | 166/383 X |
| 4,488,597 | 12/1984 | Hoppe et al. | 166/385 X |

*Primary Examiner*—Stephen J. Novosad

*Attorney, Agent, or Firm*—Antonelli, Terry & Wands

[57] ABSTRACT

A method and device are provided for carrying out measurements and/or operations in a well. The device comprises tubing of a diameter less than that of the well, at least one measurement or operation instrument as well as at least one sealing member surrounding said tubing, a base or probe support and a flexible connecting member comprising at least one electrical connection, said flexible connecting member connects the base to the measuring instrument.

14 Claims, 12 Drawing Figures

METHOD AND A DEVICE FOR CARRYING OUT MEASUREMENTS AND/OR OPERATIONS IN A WELL

BACKGROUND OF THE INVENTION

1. Field of the Invention

The present invention relates to a method and a device for carrying out measurements and/or operations in a well at the level of the surrounding formations, and more particularly formations subjected to hydraulic compression. The invention is more especially applicable when it is a question of carrying out measurements and/or operations at the level of geological formations situated in a zone which must be isolated from the rest of the well and into which a pressurized hydraulic fluid is injected so as to fracture the formations at this level (hydraulic fracturing process).

2. Description of the Prior Art

Prior hydraulic fracturing techniques are described for example in U.S. Pat. No. 3,427,652.

The measurements carried out by application of the present invention may for example comprise the triaxial recording of the noises produced by the rocks thus placed under stress. From the analysis of the vibrations detected, the orientation of the noise source can be defined and consequently the direction of propagation of the fracture. This analysis technique is well known by geophysiciens and will not be described here in greater detail.

Techniques of the prior art for determining the propagation of fractures in the ground are described for example in U.S. Pat. Nos. 3,739,871 and 3,775,739.

The measurements made may also comprise the recording of the pressure and of the bore-bottom temperature, the measurements (focused or not) of the electric resistivity of the formations, etc.

These measurements may be completed by displaying the walls of the well by means of a television camera for example.

One of the objects of the invention is to provide a device more especially for moving a measurement or operation instrument in a well zone possibly subjected to hydraulic compression, not only during but also at the end of the hydraulic fracturing of the formations surrounding this zone.

A device is already known from U.S. Pat. No. 4,349,072 for carrying out measurements and/or operations in a well, this device comprising tubing open at its lower end and having a diameter less than that of the well, a measuring or operation instrument (probe) moveable by remote control from the surface between a first position in which the instrument is housed in the lower part of the tubing forming a protecting casing and a second position in which said instrument leaves said tubing at least partially at the lower end thereof, to allow the measurement or operation and an electric transmission cable equipped with a first electric connection member adapted to be placed in the tubing so as to engage with a second electric connection member connected to said instrument.

A technique is also known from U.S. Pat. No. 2,153,254 for carrying out fluid production tests from geological formations through which a well passes, by using tubing provided at its lower part with a sealing member, or packer, coming to bear against a zone of the walls of the well having a conical shape.

These production tests comprise the monitoring and recording at the surface of the noises created by the flow of fluids produced by the geological formations.

SUMMARY OF THE INVENTION

The device of the present invention allows measurements and/or operations to be carried out in a well. It comprises a tubing (6) of a diameter less than that of the well, at least one measurement or operation instrument and comprises at least one sealing member surrounding said tubing, a probe base or support and a fixable connecting member comprising at least one electrical connection, said flexible connecting member connecting the base to the measuring instrument.

The present invention also relates to a method for carrying out measurements or operations in a well, in which there is introduced into the well an assembly comprising a tubing, at least one sealing member, a probe support or base and a connecting member connecting said probe to said base. This method comprises the following steps:

(a) said assembly is lowered into the well,
(b) said sealing member is positioned,
(c) the probe is anchored, the order for executing these last two steps being able to be reversed,
(d) the connecting member is slackened or released and,
(e) the fracturing is carried out.

In addition, the devices of the prior art are not adapted for carrying out measurements or operations at the level of formations subjected to hydraulic compression.

This problem may be resolved, in accordance with the invention, by using a device of the above defined type in which said tubing is surrounded by at least one expandable annular sealing member situated at a level higher than said measurement or operation instrument, when the tubing is disposed vertically and said instrument is placed in its first position, said annular sealing member having an axial passage through which passes a flexible connecting member comprising an electric cable connected to said instrument.

The prior devices have moreover the disadvantage of transmitting vibrations from the tubing to the probe through the extension member which connects them together, whereby there is risk of considerably disturbing the measurements made by the probe, particularly when they are acoustic measurements.

This disadvantage is overcome in accordance with the invention by applying a method for carrying out measurements and/or operations in a well, in which there is introduced into the well at least one measurement and/or operation instrument housed in a tubing, at the lower part thereof, and connected to an electric connection member by a connecting cable, then there is introduced into the tubing a transmission cable equipped with an electric connection member adapted to engage with the preceding one and said instrument is caused to project at least partially from said tubing, wherein said instrument is caused to project in the extended position of said connecting cable, then the tension of said connecting cable is released by a relative limited movement of said instrument and said tubing, before carrying out the measurement and/or operation.

BRIEF DESCRIPTION OF THE DRAWINGS

One embodiment of the invention is illustrated by the accompanying drawings in which.

DESCRIPTION OF THE PREFERRED EMBODIMENTS

Figure 1:
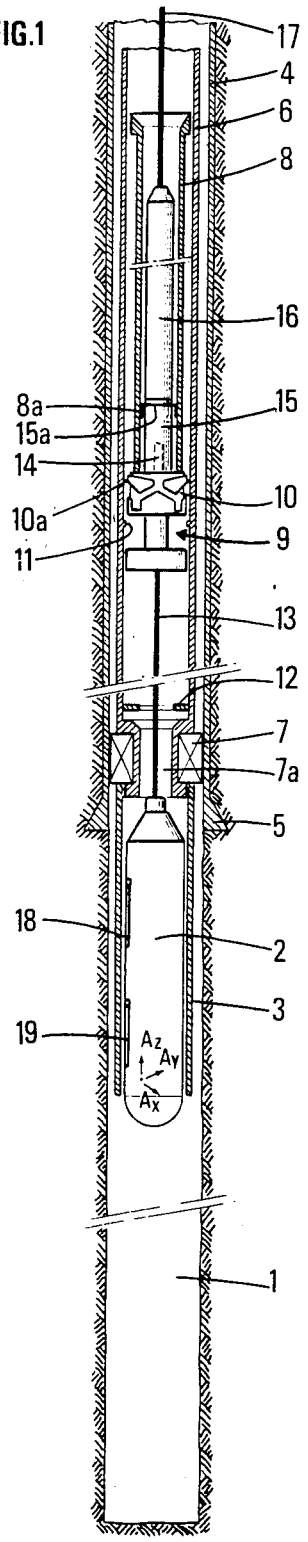
FIGS. 1 and 2 illustrate respectively the initial position and the working position of the device in accordance with the invention, lowered into a well which passes through geological formations.
Figure 2:
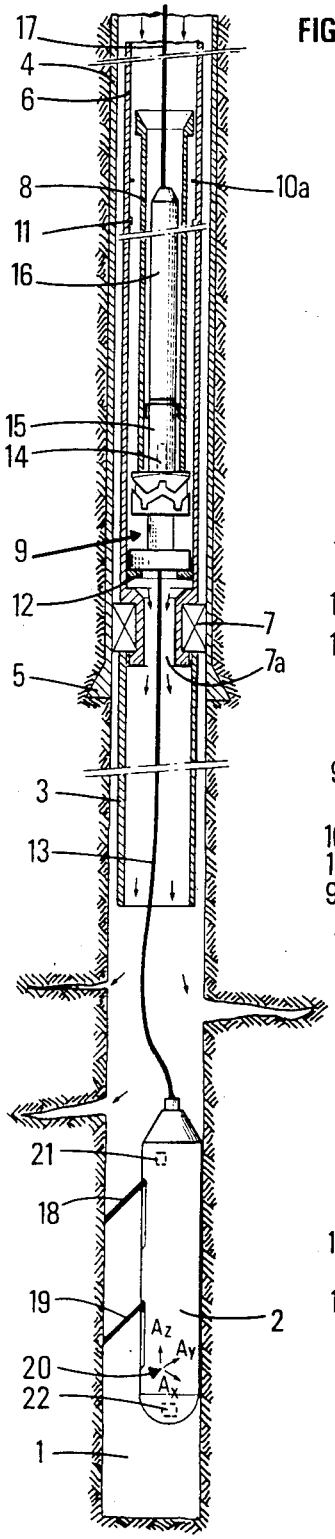

FIG. 1 and 2 correspond respectively to the initial position of the device of the invention, lowered into a partially tubed well 1 and to the working position of this device in which probe 2 has left its protecting casing 3.

Well 1 is equipped over a certain length with a tubing 4 ending in a hoof shaped portion 5 at its lower part.

The device shown comprises at its lower part the protecting casing 3 in which the measuring or operation instrument 2 is at least partially housed and above which is mounted a tubing 6 to which this casing is connected.

It will be assumed hereafter, by way of example, that instrument 2 is a diagraphy probe, but it could just as well be formed by a television camera, or an operating instrument such for example as a boring tool, etc.

An annular sealing member 7, radially expandable, which may be of a conventional type (packer), is inserted between casing 3 and tubing 6.

The radial expansion of this member is obtained for example by axial movement of tubing 6, causing the anchoring wedges of the packer to move apart. A hydraulic anchoring packer of a known type may also be used, for example pattern AD1 of the firm BAKER OIL TOOLS. In its expanded position, this member 7 is pressed against the wall of tubing 4. Casing 3 and tubing 6 are both open at their ends.

A tubular support element 8 is housed in tubing 6, this tubular element being open at its upper part and comprising at its lower part a support piece or base 9 equipped with an anchoring system.

Probe 2 is connected to base 9 by a flexible connection, that is to say of negligible stiffness which, in the illustrated embodiment, is formed by a support cable 13 passing through an axial passage 7*a* in member 7 and of a length such, in the high position of base 9 (FIG. 1), that probe 2 is housed, at least partially, inside its protecting casing 3, whereas, in the low position of base 9, the probe 2 has left casing 3 (working position shown in FIG. 2).

Cable 13 contains electric conductors for supplying power and for transmitting the measurements which connect probe 2 electrically to a male multi contact electric plug 14 disposed on base 9. This male plug is adapted to receive a complementary female socket 15 over which is mounted a loading or ballasting bar 16.

An anchorage system, either mechanical (For example shearable washers adapted to socket 15 and cooperating with retaining members integral with tube 8), or hydroelectric (anchoring wedges actuated by a remote controlled motor) provides a mechanical connection between bar 16 and base 9 when the electric contact is provided between the male plug 14 and the female socket 15.

The assembly formed by the female socket 15 and loading bar 16 is fixed to the lower end of a cable 17 containing electric conductors for supplying power and for transmitting the measurements made by probe 2.

Examples of electric connectors which may be used for forming the male plug 14 and female socket 15 assembly are described in the French patent of invention No. 2,484,717 and in the published French patent application No. EN 81/05306 "Plug-in electric connector in a liquid medium" filed on Mar. 17, 1981.

Probe 2 may for example be of a known type and comprise hinged anchoring arms 18, 19 folded back along the probe body when this probe is housed in the protecting casing (FIG. 1), these arms being opened out hydraulically by remote electric control from the surface, by means of cables 17 and 13, when probe 2 has left casing 3, in the working position shown in FIG. 2, arms 18 and 19 then anchoring themselves in the wall of the well and pressing probe 2 against this wall on the diametrically opposite side (FIG. 2).

These arms may be connected to one or more shoes to be applied against the wall of the well.

In one example of application in which probe 2 is used for detecting and recording acoustic signals produced by geological formations cracked by hydraulic fracturing, this probe may more particularly comprise triaxial dynamic accelerometers 20, recording the components $A_x$, $A_y$ and $A_z$ of the noise along three axes perpendicular to each other. This noise comprises the compression waves and the shearing waves. This probe may also comprise a hydrophone recording the compression waves of the fluid contained in the hole and pressure sensors 21 and 22 measuring respectively the hydrostatic pressure reigning in the well outside the probe and the pressure with which arms 18 and 19 are applied against the wall.

This probe may also comprise sensors for determining in a way known per se:

its slope with respect to the vertical as well as the angle formed by a reference generatrix of this probe with the vertical plane passing through the axis of the probe ("tool face") by means of triaxial static accelerometers or inclinometers, the orientation of the probe with respect to magnetic north, i.e. the angle which the vertical plane passing through the axis of the probe forms with the vertical plane containing the magnetic north (by means of triaxial magnetometers or a compass).

When the probe is substantially vertical, only the angle between the vertical plane containing the axis of the probe and the reference generatrice and the vertical plane containing the magnetic north is considered using triaxial dynamic magnetometers or a compass.

Figure 3C:
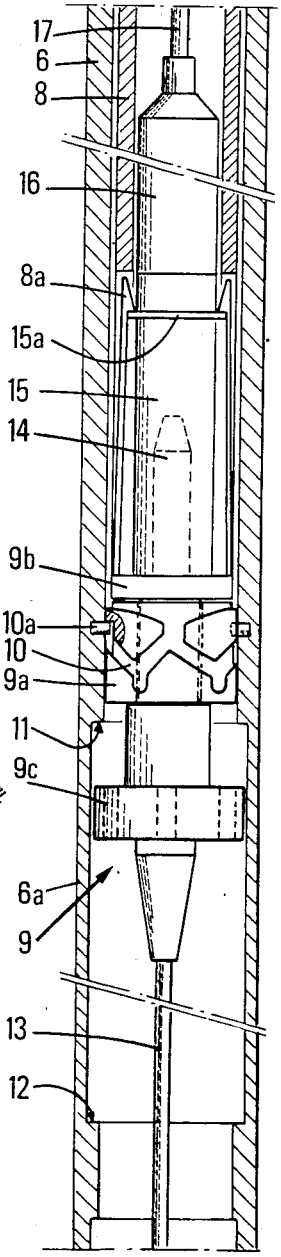
FIG. 3C is a detailed view of the device in the vicinity of this anchoring system.

In the example given above, base 9 of the tubular support element 8 is provided with an entirely mechanical anchorage system comprising a groove 10 cooperating with retaining studs 10*a*. With this system, the tubular element may be held in a first position, as shown in FIG. 1, in which the lower part of base 9 is below a top stop which may be formed by a first internal shoulder 11 of tubing 6 (FIG. 3C) at a sufficient distance therefrom so that the anchorage system may be unlocked by raising the base 9 (see below).

When groove 10 is disengaged from the retaining studs 10*a*, the tubular support element 8 comes into a low position under a gravity effect, its base 9 then resting on a low stop formed by a second internal shoulder 12 in tubing 6.

Base 9 as well as the internal shoulders 11 and 12 have recesses or bores allowing a hydraulic fluid to flow along the whole length of tubing 6, about the tubular support 8, in both positions of probe 2.

Figure 3A:
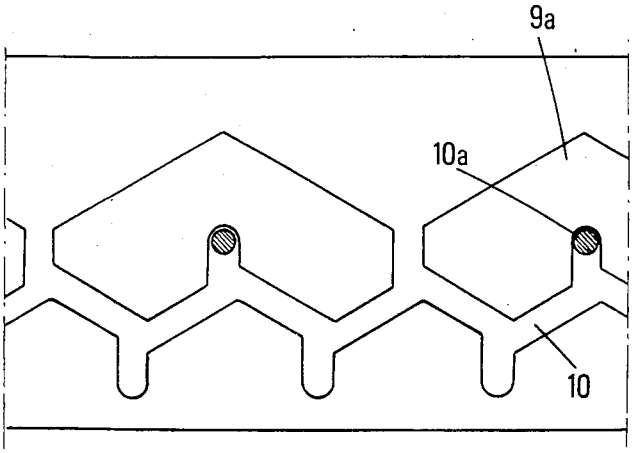
FIGS. 3A and 3B show schematically in a developed view the system for anchoring the tubular support element, respectively in the locked position of this element and during unlocking thereof.
Figure 3B:
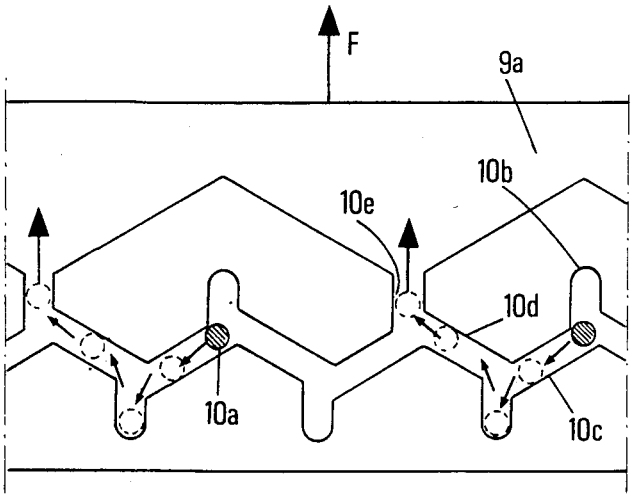

As shown schematically in FIGS. 3A and 3B, the anchoring system 10 may comprise a groove in the form of a W formed in the external wall base 9 of the tubular support element 8, this base 9 being rotatable about a vertical axis with respect to tubing 6. In the top position shown in FIGS. 3A and 3C, the upper edge of the top of this groove is supported by a stud 10*a* integral with the internal wall of tubing 6.

By slightly raising the assembly 16-15-14-8-9 by a pull F exerted on cable 17 from the position shown in FIG. 3A, notch 10*b*, at the upper part of groove 10 is disengaged from stud 10*a*. The lower edge 10*c* of groove 10 then bears on this stud, causing a rotation of base 9 which brings the upper edge 10*d* of groove 10 opposite the stud. By releasing the pull F, edge 10*d* comes to bear on stud 10*a*, causing base 9 to rotate until it is disengaged from stud 10*a* through the opening 10*e* (FIG. 3B). The above mentioned assembly then drops by gravity as far as its low position shown in FIG. 2. Instead of the above described entirely mechanical anchoring system, base 9 could comprise as electro-hydraulic anchoring system remote controlled from the surface.

Figure 4:
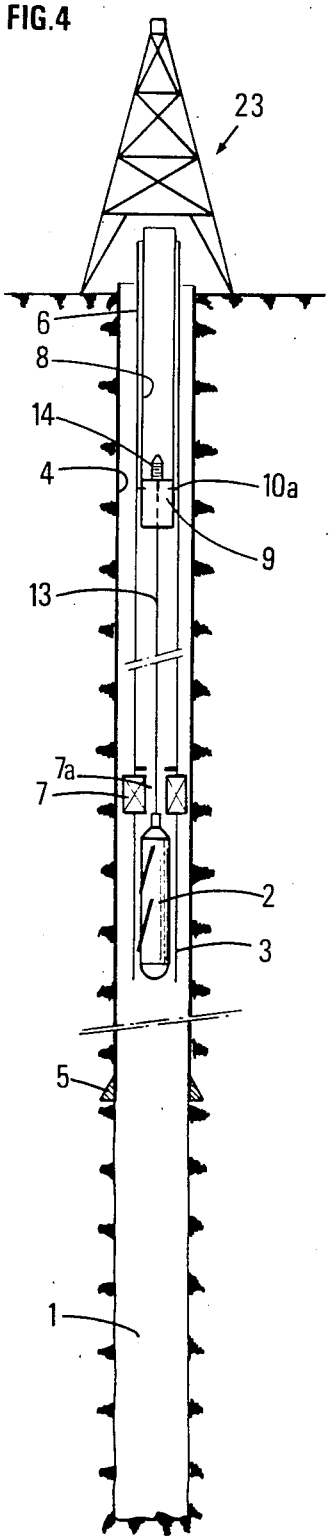
FIG. 4 to 8 illustrate the different phases of using the device according to the invention.

The operation of this device is described below with reference to FIGS. 4 to 8 which show the successive steps of this technique. FIG. 4 illustrates the first step in which first of all the packer 7 is fixed to the lower end of tubing 6 on the surface. Then into this latter, which is disposed vertically, is inserted the tubular support element 8 which is placed in the top position (FIG. 1), base 9 resting on studs 10*a* through the anchoring groove 10, while passing the electric cable 13 previously connected to base 9 through the packer 7.

Figure 5:
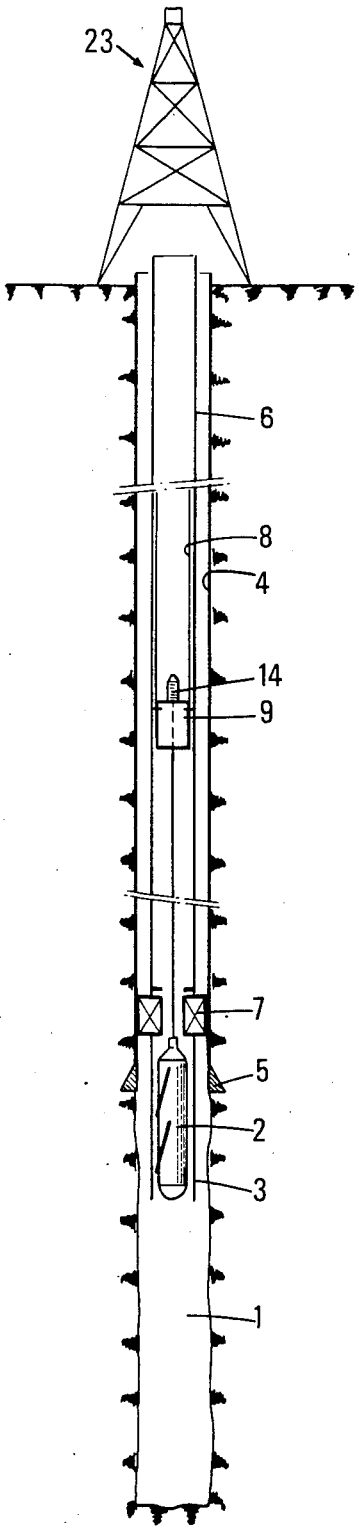

The probe (or operational tool) 2 is then fixed under packer 7 at the lower end of cable 13 and is thus suspended from studs 10*a* in its top position shown in FIG. 1. Then, to the lower end of packer 7 is fixed the protecting casing for the probe which is housed inside the casing. The assembly is then gradually lowered into the well 1 (FIG. 4) from the drilling tower 23, while adding successive tubing elements 6 until the probe 2 reaches the desired depth, substantially at the level of the hoof shaped portion 5, the depth reached being known at any moment from the number of tubing elements 6 connected end to end. When this position is reached, packer 7 is anchored to the lower end of tubing 4 (FIG. 5).

Tubing 6 is connected at its upper part to a duct 24 for supplying pressurized hydraulic fluid and is provided at its top with a safety valve or packing box 25 through which is slid cable 17 supporting the assembly formed by the loading bar 16 and the female socket 15, until this end is connected to the male plug 14 fixed on base 9 of the tubular element 8 which supports the probe, the tubular support element 8 providing guiding of assembly 15-16 for facilitating this connection.

Mechanical connection or engagement members 15*a* and 8*a* are respectively fitted to socket 15 and to the internal wall of tube 8, these members being adapted to be disengaged from each other by a sufficient pull exerted on cable 17 from the surface.

In the example considered, members 15*a* and 8*a* are formed respectively by a shearable washer carried by socket 15 or loading bar 16 and arms or knives for retaining this washer, carried by the tubular support element 8.

Figure 6:
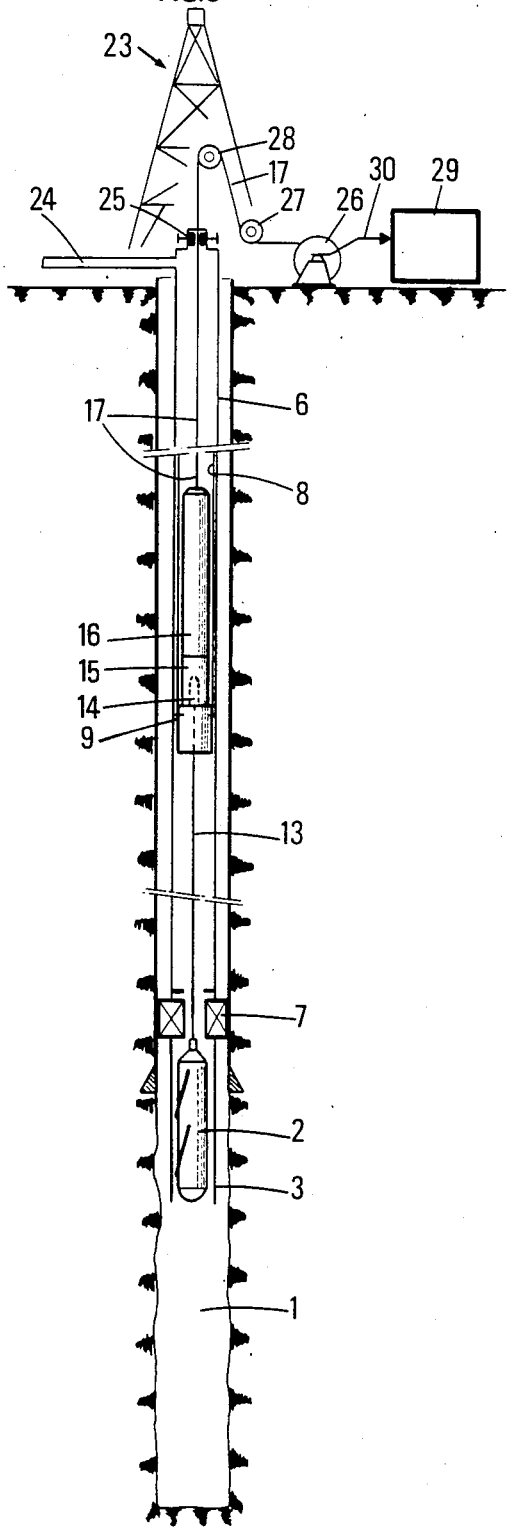

Cable 17 is unwound from the surface from a winch 26. Between winch 26 and valve 25, the cable 17 passes over guide pulleys 27 and 28 (FIG. 6).

Figure 7:
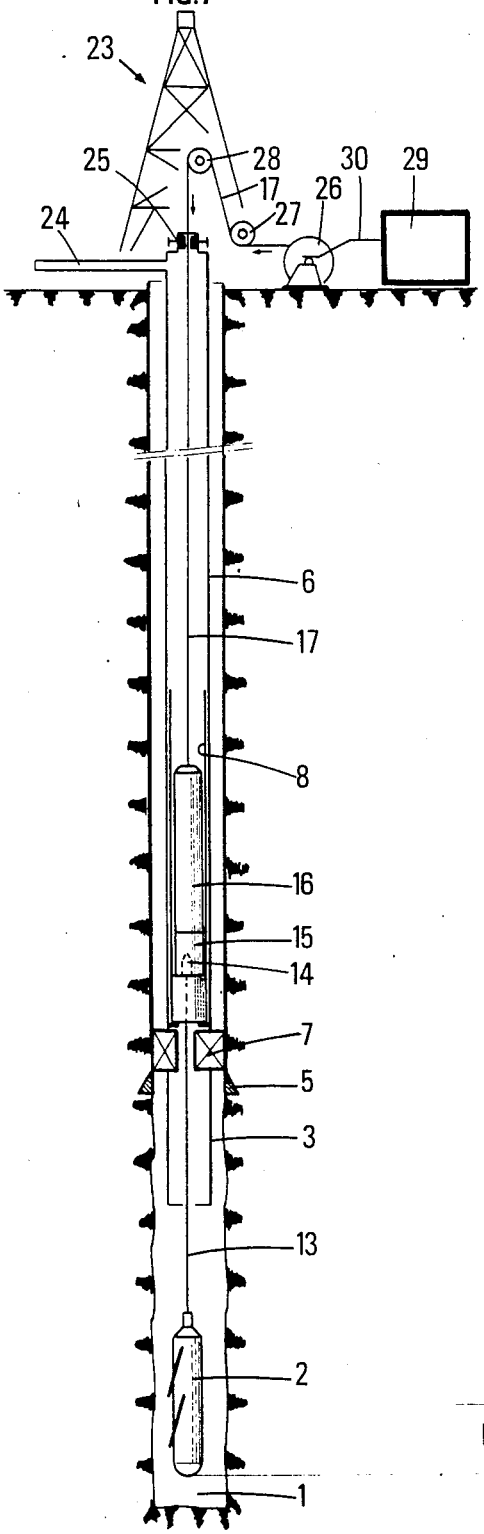

When the operation for electrically connecting socket 15 with plug 14 as well as the mechanical connection between bar 16 and base 9 have been performed, a slight pull F exerted on cable 17 (FIG. 3B) disengages stud 10*a* of base 9 from tubular element 8 which then passes to its low position corresponding to FIG. 2, probe 2 being out of its protecting casing 3 and being then situated in the lower untubed or uncovered part of the well A (FIG. 7).

Then the support tube 8 of probe 2 is slightly raised and consequently this probe itself by a height h (insufficient to cause it to go back into its casing 3) by a pull exerted on cable 17 and, in this position of the probe (FIG. 8), the opening of the hinged arms 18 and 19 is remote controlled by station 29 by means of cables 17 and 13. The ends of these arms anchor themselves in the wall of well 1, while pressing probe 2 against the wall portion diametrically opposite these arms.

Figure 8:
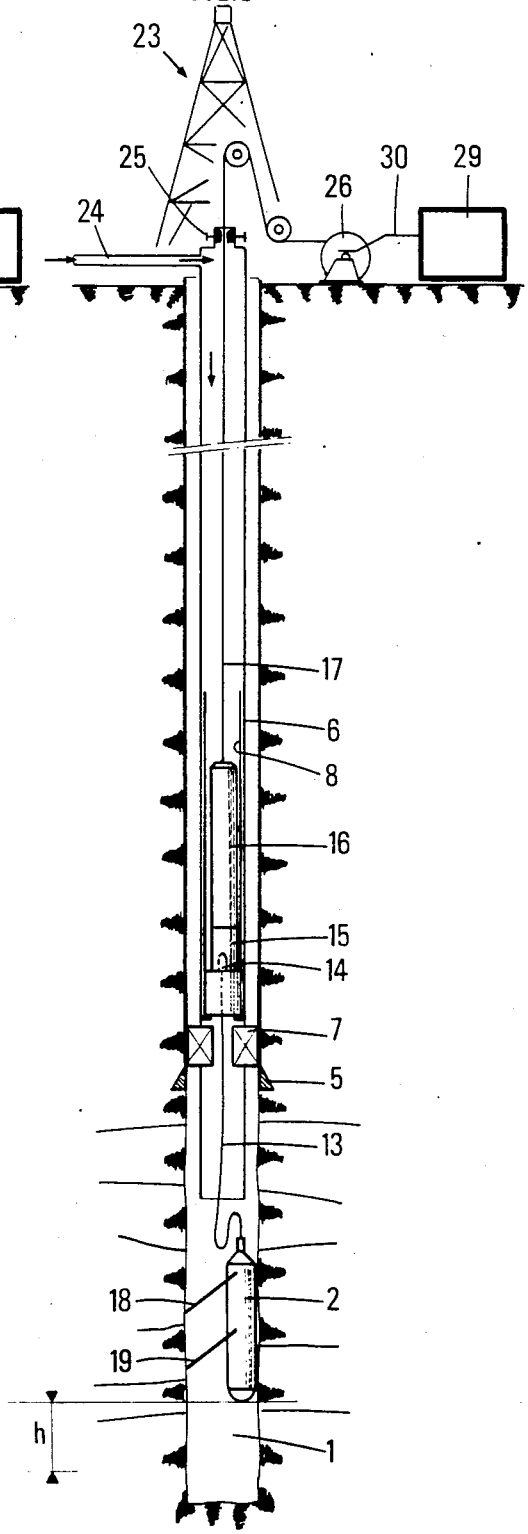

The pull exerted on cable 17 from the surface is released and the support tube 8 then drops to its low position under the effect of gravity. This results in giving a certain slackness to cable 13 thus eased (FIG. 8).

Thus, measurements or operations may now be carried out by means of the probe or instrument 2 without transmitting to this probe or instrument the vibrations of tubing 6.

The device of the invention comprises therefore means for protecting said instrument 2 from the vibrations of said tubing 6 during measurement or an operation. These means are formed by the combination of members 18, 19 for anchoring said instrument 2 at a fixed level in well 1, these latter being actuated by remote control, and a flexible connection 13 between said instrument 2 and a support piece 9 moveable in tubing 6 between position close to the top stop 11 and a low abutment position 12 which define respectively first and second positions of said instrument 2.

The signals for remote control of probe 2 from the surface, as well as the measurement signals coming from probe 2 and the electric current supplying this latter, are transmitted respectively from and to the surface station 29 through conductors incorporated in cables 13 and 17, the electrical connection between these conductors and station 29 being provided in a way known per se by a set of brushes rubbing on connector rings integral with the shaft of winch 26.

The hydraulic fracturing of the formation situated under packer 7 may be achieved by pumping pressurized hydraulic fluid through duct 24 situated on the surface.

When the different operations or measurements are finished, the closure of hinged arms 18 and 19 is remote controlled from the surface, probe 2 is withdrawn into its protecting casing by a pull on cable 17 bringing the base 9 of support tube 8 back into the top position shown in FIG. 1 where this base 9 is supported by stud 10*a*. Then the geological formations are slowly decompressed by reducing the pressure in duct 24.

The engagement of groove 10 and studs 10*a* takes place similarly to the disengagement described above with reference to FIGS. 3A and 3B.

A sufficient pull on cable 17 shears washer 15*a* and thus disconnects the female electric socket 15 from the male plug 14, base 9 coming into abutment against the top stop 11, and the assembly formed by the female socket 15 and the loading bar 16 mounted above this socket may be drawn up by means of cable 17.

Assembly 8, 9, 13, 12 remains suspended from the retaining studs 10*a* integral with tubing 6, through a W shaped anchoring system designated by the reference 10.

Tubing 6 may then, in its turn, be withdrawn gradually from the well, the elements of this tubing being successively disconnected at the surface.

One embodiment has been described above, by way of example, in which the annular sealing member 7 is disposed under base 9. This embodiment has the advantage of placing member 7 in the immediate vicinity of the hoof shaped portion 5 and of limiting the length of the uncovered portion between the base of this hoof shaped portion and the bottom.

However, it would still be within the scope of the invention to place the whole of equipment 8,9 at a level lower than that of the sealing member 7 whose axial passage 7*a* would then have the transmission cable 17 passing therethrough. This latter embodiment has the following advantages:

the mechanical assembly under packer 7 is under the same pressure as the hydraulic fluid compressed below this packer, it is possible to provide in tubing 6 openings for the flow of fluid, below the level of member 7, between this latter and the level of the top stop 11.

Moreover, other embodiments of the above defined equipment are also possible.

It will for example be possible to place the sealing member 7 in an untubed zone of the well which will be isolated from the rest of the well by using a sealing member completely closing off the well at a level lower than that of the instrument or probe in its low position.

In a variant of this latter embodiment, tubing 4 descends below the whole sealing member defined above. In the zone defined by the two sealing members, the tubing 4 is perforated in a conventional way, so as to allow the hydraulic fluid injected to flow through the formations situated at this level.

When the whole of the device is under hydraulic pressure, it is possible to move the instrument or probe 2 by simply pulling on cable 17 from the surface, after having closed arms 18 and 19 by remote control.

When the above described technique is applied to very devious or horizontal wells, the instrument or probe 2 may be caused to leave casing 3 by pumping hydraulic fluid followed possibly by moving tubing 6 from the surface, so as to release the tension in cable 13 before carrying out the measurement or operation by means of the probe or instrument 2.

It would still be within the scope of the invention to provide several measurement or operational probes or instruments suspended from each other under the support piece 9.

Figure 9:
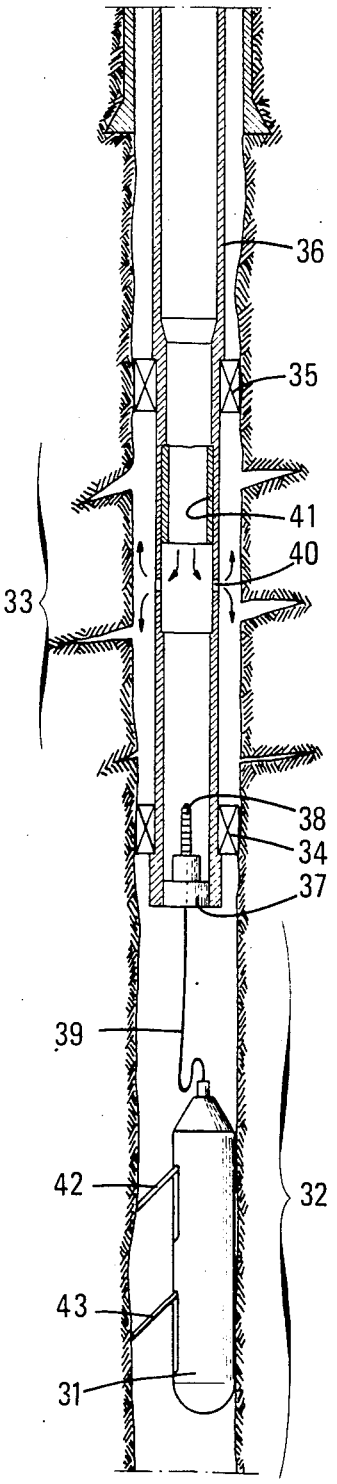
FIG. 9 and 10 illustrate schematically two other embodiments of the device of the invention.

In another embodiment of the invention, shown in FIG. 9, probe 31 is situated in a zone 32 of the well in which fracturing will not be carried out. Fracturing is performed in a zone 33 defined by two sealing members 34 and 35, which, in the examples shown in FIG. 9, are supported by tubing 36.

This tubing 36 carries a probe support 37, or base, comprising a connector 38, possibly male, which will cooperate with a complementary connector as is shown in FIGS. 1, 2 or 3.

The probe support 37 is connected to probe 31 by means of a flexible mechanical connecting member 39 comprising at least one electrical connection.

Tubing 36 comprises at least one opening 40 located between the two sealing members 34 and 35. It is through this opening that the fluid will be introduced for fracturing the zone of the well designated by reference 33.

If the sealing members are of the hydraulic anchoring type, opening 40 may be closed off in a first stage by a liner 41 for positioning the sealing members, then this liner will be moved according to the so called wire line technique so as to free opening 40 and allow fracturing of the zone 33 to be fractured.

Of course, at least during the fracturing time, the probe support 37 is sealed and prevents any flow of the fracturing fluid towards zone 32 where the measurements or operations are performed.

The operation of the above described device is the following:

the assembly formed by tubing 36, sealing members 34 and 35, the probe support 37, the flexible connecting member 39 and probe 31 is lowered into a well. The slant of the well is such that, when probe 31 is subjected to gravity forces, it maintains the flexible connecting member stretched.

the probe is anchored in the well by means of arms 42 and 43.

the tubing is lowered into the well to a depth, called relaxation depth, sufficient for relaxing the connecting member 39 without meeting probe 31. Of course, the probe may be anchored in the well at a position such, and the relaxation depth may be such, that fracturing takes place in a predetermined zone of the well, the sealing members are positioned and the fracturing operation may begin.

In this embodiment of the invention, a substantially pressure balanced system is provided, since the pressure forces of the fracturing fluid are exerted on the two sealing members in opposite directions and thus the tubing is not subjected to a vertical force due to the pressure forces of the fracturing fluid.

Figure 10:
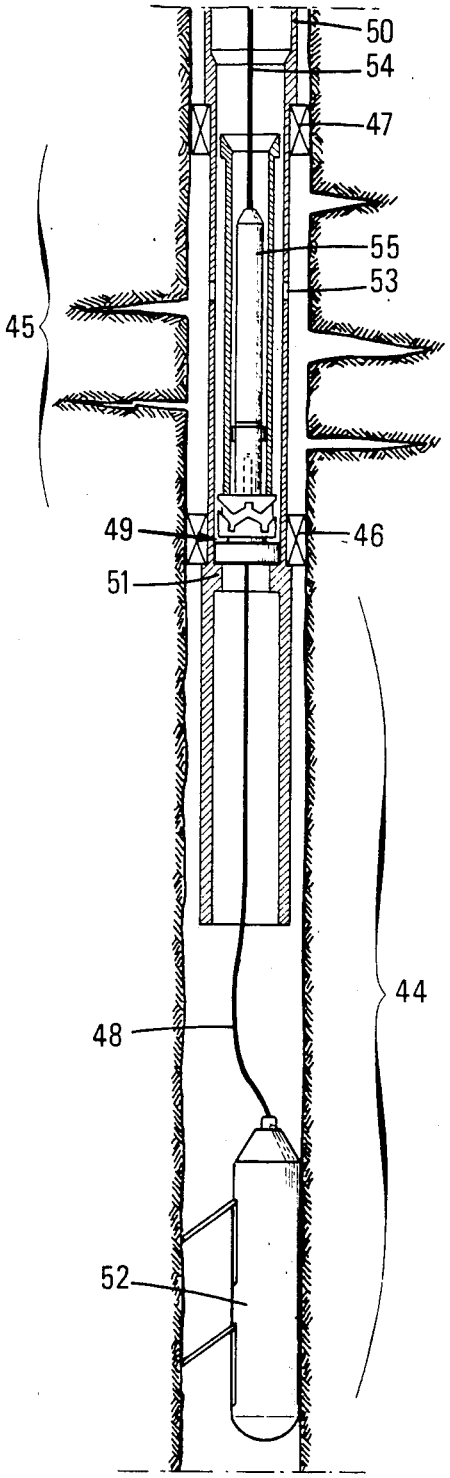

FIG. 10 also shows an embodiment in which the measurements are carried out in a zone of well 44 which will not be fractured.

Fracturing will take place in a fracturing zone 45 defined by at least two sealing members 46 and 47.

This embodiment is differentiated from the one shown in FIG. 9 in that the flexible connecting member 48 is fixed to a probe support or base 49 moveable in tubing 50. The movement of base 49 is limited by at least one low stop 51. In this position, base 49 prevents any flow of the fracturing fluid towards the zone of the well 44 where the measurements are carried out.

With this embodiment, probe 52 may be moved even after the sealing members 46 and 47 have been anchored.

With this embodiment, it is also possible to move the probe during fracturing. In this case, the mechanical connection or engagement members must allow a sufficient pulling force to be transmitted to overcome the action of the pressure forces on base 49. Similarly, base 49 will have to remain sealed during this movement.

Of course, in this case, the opening 53 for the passage of the fracturing fluid may be placed closer to the upper sealing member 47, and likewise the low stop 51 may be placed in a lower position with respect to sealing member 46.

One example of putting this embodiment into effect is given hereafter:

(a) the assembly comprising tubing 50, base 49, the flexible connecting member 48, probe 52 and sealing members 46 and 47 is lowered, (b) the sealing members are positioned as required when the base 49 is in the low position, (c) a connector 55 connected to a cable 54 is lowered from the surface, said connector cooperating with base 49 so as to provide electrical and mechanical connection, (d) probe 52 is anchored when base 49 is not in contact with stop 51, (e) base 49 is lowered by means of cable 54 connected to the surface until it meets stop 51, so as to relax the flexible connecting member 48, and (f) fracturing is accomplished.

Step (b) may be performed before step (c) or after step (d).

What is claimed is:

1. A device for carrying out measurements and/or operations in a well extending from a surface of the earth, said device comprising a tubing of a diameter of less than that of the well, at least one measuring or operating instrument, at least one sealing member surrounding a lower portion of said tubing, a support member located above said instrument and supported by said tubing, a flexible connecting member comprising at least one electrical connection, said flexible connecting member connecting said support member to said instrument, and means for causing the support member to move in said tubing between a first position and a second position corresponding respectively to one position in which said instrument is protected within the tubing and another position in which the instrument is partially out of said tubing; said tubing extending from the surface to a position within said well above a working position of said instrument.

2. The device according to claim 1, wherein said flexible connecting member includes a flexible electric cable.

3. A device for carrying out measurements and/or operations in a well extending from a surface of the earth, said device comprising a tubing of a diameter of less than that of the well, at least one measuring or operating instrument, at least one sealing member surrounding a lower portion of said tubing, a support member located above said instrument and supported by said tubing, a flexible connecting member comprising at least one electrical connection, said flexible connecting member connecting said support member to said instrument and said tubing extending from the surface to a position within said well above a working position of said instrument, and means for subjecting a zone of said well to hydraulic compression, said tubing being open at a lower end and means actuated at the surface to cause said at least one instrument to move between a first position in which said instrument is housed in a lower portion of the tubing that forms a protecting casing and a second position in which said instrument is at least partially out of said tubing available to effect said measurements or operations, an electrical transmission cable equipped with an electric connecting member adapted to be moved in the tubing for connection with an electrical connection connected to said instrument, said at least one sealing member being an annular member having an axial passage through which passes the flexible connecting member, said flexible connecting member further comprising an electric cable connected to said instrument.

4. The device according to claim 3, further comprising means for retaining said support member in a first position, said means being unlockable by a simple pull on said transmission cable, whereby said support member and said instrument are respectively disposed above and below said annular sealing member, said electric connecting cable passing through said axial passage of said annular sealing member.

5. A device for carrying out measurements and/or operations in a well extending from a surface of the earth, said device comprising a tubing of a diameter of less than that of the well, at least one measuring or operating instrument, at least one sealing member surrounding a lower portion of said tubing, a support member located above said instrument and supported by said tubing, a flexible connecting member comprising at least one electrical connection, said flexible connecting member connecting said support member to said instrument and said tubing extending from the surface to a position within said well above a working position of said instrument, a transmission cable coupled to said support member, means for causing the support member to move in said tubing between a first position and a second position corresponding respectively to one position in which said instrument is protected within the tubing and another position in which the instrument is partially out of said tubing and means for retaining said support member in said first position, said means being unlockable by a simple pull on said transmission cable, whereby said support member and said instrument are both disposed below said sealing member.

6. A device for carrying out measurements and/or operations in a well extending from a surface of the earth, said device comprising a tubing of a diameter of less than that of the well, at least one measuring or operating instrument, at least one sealing member surrounding a lower portion of said tubing, a support member located above said instrument and supported by said tubing, a flexible connecting member comprising at least one electrical connection, said flexible connecting member connecting said support member to said instrument and said tubing extending from the surface to a position within said well above a working position of said instrument, means for protecting said instrument from the vibrations of said tubing during the measurement by or the operation of said instrument, said protecting means being formed by a combination of members for anchoring said instrument at a fixed level in the well, means for actuating said anchoring members by remote control from said surface whereby the support member is moveable in said tubing between first and second positions.

7. A device for carrying out measurements and/or operations in a well extending from a surface of the earth, said device comprising a tubing of a diameter of less than that of the well, at least one measuring or operating instrument, at least one sealing member surrounding a lower portion of said tubing, a support member located above said instrument and supported by said tubing, and a flexible connecting member comprising at least one electrical connection, said flexible connecting member connecting said support member to said instrument and said tubing extending from the surface to a position within said well above a working position of said instrument, said at least one sealing member comprises at least two sealing members defining a zone of the well to be fractured.

8. A device for carrying out measurements and/or operations in a well extending from a surface of the earth, said device comprising a tubing of a diameter of less than that of the well, at least one measuring or operating instrument, at least one sealing member surrounding a lower portion of said tubing, a support member located above said instrument and supported by said tubing, a flexible connecting member comprising at least one electrical connection, said flexible connecting member connecting said support member to said instrument and said tubing extending from the surface to a position within said well above a working position of said instrument, said instrument having means for supporting said instrument on a wall portion of said well at a position outside of said tubing in which said flexible connecting member is free of tension.

9. A device according to claim 8, further comprising retaining means for securing said support member to said tubing.

10. A device according to claim 9, wherein said retaining means comprises a stop member integral with a wall portion of said tubing.

11. A method for carrying out measurements or operations in a well extending from a surface of the earth, wherein an assembly is introduced into said well, said assembly comprising a tubing defining an annular space with a wall of said well, at least one measuring or operating instrument, a support member, a flexible connecting member connecting said member to said to said instrument, means for anchoring said instrument in said well and remote control means for actuating said anchoring means, said method comprising the following steps:

(a) lowering said assembly into the well;

(b) positioning said instrument in the well while maintaining the flexible connecting member stretched;

(c) anchoring said instrument in said well by actuating the the remote control means which in turn actuates the anchoring means; and (d) relaxing said flexible connecting member.

12. A method according to claim 11 for carrying out the measurements or operations, when the well is achieved in geological formation which is to be fractured, the assembly further comprising a sealing member and another remote control means for actuating said sealing member surrounding said tubing at a lower end portion; said method further comprising the steps of:

(e) actuating said another remote control means so as to isolate said annular space into two portions;

(f) positioning said instrument in the well while maintaining the flexible connecting member stretched, the order of steps (e) and (d) being reversible; and (g) after anchoring said instrument in said well by actuating the remote control means which in turn actuates the anchoring means and after relaxing said flexible connecting member, then fracturing the geological formation.

13. A method for carrying out measurements and/or operations in a well, which comprises introducing into the well a measuring or operating instrument that is housed in a tubing at a lower part thereof, and that is connected to a first electrical connecting member by a connecting cable; then introducing into the tubing a transmission cable equipped with a second electrical connecting member adapted to connect with the first electrical connecting member; causing said instrument to leave said tubing at least partially with said connecting cable being placed in an extended position under tension; then releasing the tension of said connecting cable by a limited relative movement of said instrument in said tubing, and therefore effecting a measurement and/or an operation with said instrument.

14. A device for carrying out measurements and/or operations in a well extending from a surface of the earth, said device comprising a tubing of a diameter of less than that of the well, at least one measuring or operating instrument, at least one sealing member surrounding a lower portion of said tubing, a support member located above said instrument and supported by said tubing, a flexible connecting member comprising at least one electrical connection, said flexible connecting member connecting said support member to said instrument and said tubing extending from the surface to a position within said well above a working position of said instrument, said instrument being a probe adapted for detecting acoustical signals produced by fractured formations.

* * * * *